United States Patent [19]

Philipp

[11] Patent Number: 5,014,706

[45] Date of Patent: May 14, 1991

[54] ORTHOTIC INSOLE WITH REGIONS OF DIFFERENT HARDNESS

[75] Inventor: Alexander Philipp, Garbsen, Fed. Rep. of Germany

[73] Assignee: C. Nicolai GmbH & Co. KG, Hanover, Fed. Rep. of Germany

[21] Appl. No.: 463,265

[22] Filed: Jan. 10, 1990

Related U.S. Application Data

[63] Continuation-in-part of Ser. No. 245,012, Sep. 15, 1988, abandoned.

[51] Int. Cl.[5] ..... A61F 5/14; A43B 13/38

[52] U.S. Cl. ..... 128/581; 36/43

[58] Field of Search ..... 128/581, 586, 591; 36/43, 44, 88, 91

[56] References Cited

U.S. PATENT DOCUMENTS

| | | | |
|---|---|---|---|
| 2,863,231 | 12/1958 | Jones | 128/586 X |
| 3,275,002 | 9/1966 | Scholl | 128/581 |
| 3,903,621 | 9/1975 | Dubner | 128/586 X |
| 4,408,402 | 10/1983 | Looney | 36/43 |
| 4,633,877 | 1/1987 | Pendergast | 128/581 |
| 4,841,648 | 6/1989 | Shaffer et al. | 36/43 |

FOREIGN PATENT DOCUMENTS

| | | | |
|---|---|---|---|
| 125919 | 11/1947 | Australia | 128/581 |
| 1790894 | 3/1959 | Fed. Rep. of Germany . | |

*Primary Examiner*—Edgar S. Burr
*Assistant Examiner*—Moshe I. Cohen
*Attorney, Agent, or Firm*—Peter K. Kontler

[57] ABSTRACT

An orthotic insole has an outline resembling that of a foot. The portions of the insole corresponding to the calcaneus, first metatarsal head, fifth metatarsal head and toes consist of elastically deformable material having a relatively low first hardness. The portion of the insole corresponding to the lateral longitudinal arch consists of elastically deformable material having a second hardness greater than the first hardness. Alternatively, such portion is provided with a cavity at the underside thereof. The portion of the insole corresponding to the medial longitudinal arch is formed with a recess which receives an elastically deformable, interchangeable, wedge-like supporting member. The portion of the insole which corresponds to the area extending back from the metatarsal arch between the lateral and medial longitudinal arches consists of elastically deformable material having a third hardness greater than the first and second hardnesses. The wedge-like supporting member has a hardness which can be greater than, equal to or less than the third hardness but exceeds the first hardness.

25 Claims, 3 Drawing Sheets

FIG. 6
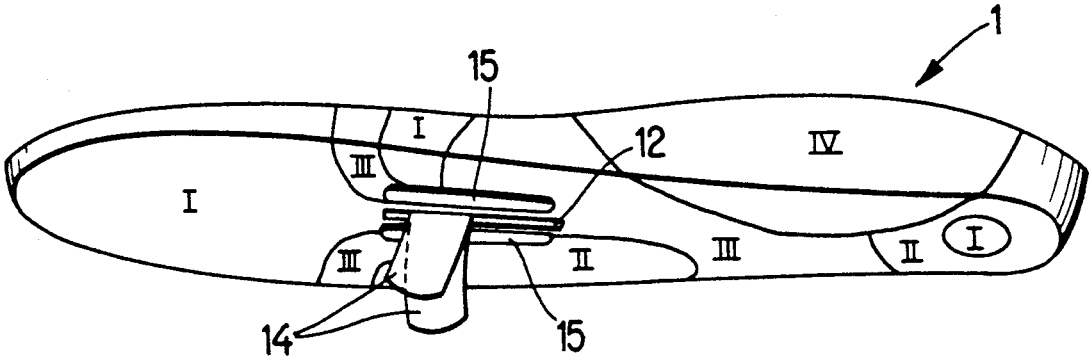
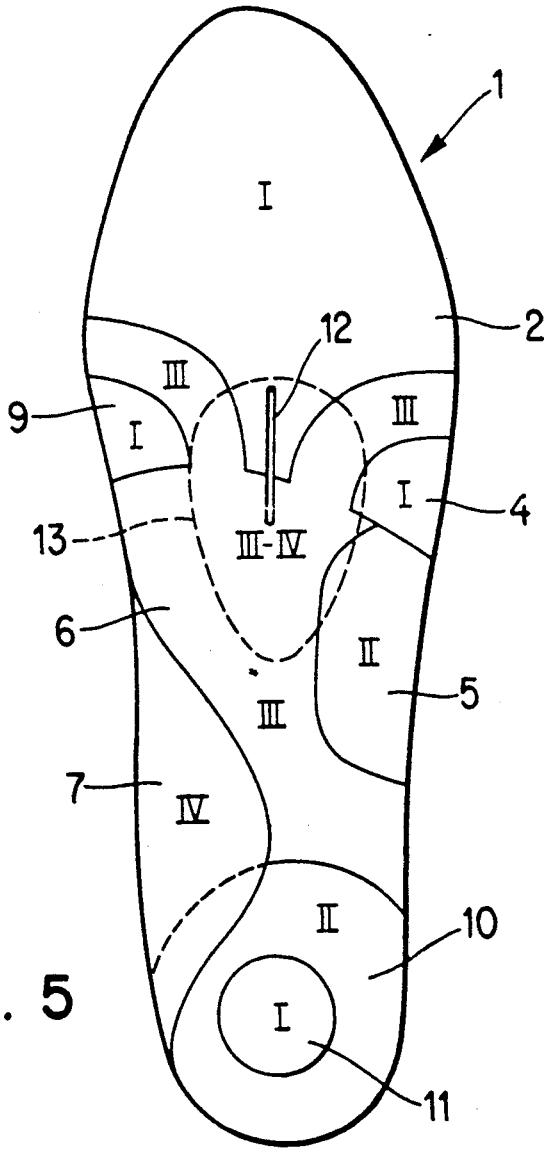
FIG. 5

ORTHOTIC INSOLE WITH REGIONS OF DIFFERENT HARDNESS

This application is a continuation-in-part of Ser. No. 245,012, filed Sept. 15, 1988, now abandoned.

BACKGROUND OF THE INVENTION

The invention relates generally to an insole.

More particularly, the invention relates to an insole which can function as an orthotic.

The foot, which constitutes a bony supporting element for the human skeletal system has an arched structure. This structure is made up of a medial longitudinal arch, a lateral longitudinal arch and a metatarsal arch. Of these, only the lateral longitudinal arch is largely supported by bone. The medial longitudinal arch and metatarsal arch, in contrast, are braced by ligaments and muscles.

The bracing of the arches slackens with increasing age so that the arches fall thereby making the foot longer and wider. This change in foot structure causes the natural padding provided by the sole to be lost and the condition of the foot as a whole deteriorates. Eventually, toe deformations and pressure sores develop.

In an attempt to alleviate these problems, orthotics in the form of insoles have been devised. For instance, the West German Utility Model No. 17 90 894 discloses a shaped insole of foamed material which consists of several superimposed layers and is divided into a small number of large areas having different hardnesses. The lower side of the insole which faces the sole of the shoe or other article of footwear has a different hardness than the upper side which is adjacent to the foot. The hardness of the upper side differs from the hardnesses of the metatarsal pad, the fallen arch support and the heel cushion.

A drawback of conventional orthotic insoles is that these are designed based primarily on static considerations. However, the shape of the foot, as well as its load-carrying ability and efficiency, are influenced not only by static variables but also by dynamic variables.

SUMMARY OF THE INVENTION

It is an object of the invention to provide an orthotic insole capable of yielding improved relief for foot problems.

Another object of the invention is to provide an orthotic insole which makes it possible to take into account both static and dynamic variables affecting the foot.

An additional object of the invention is to provide an orthotic insole which can be readily adjusted to individual deformities of the foot so as to considerably ease numerous maladies, such as knee, hip and spinal problems, resulting from improper static positioning while, at the same time, improving walking patterns.

The preceding objects, as well as others which will become apparent as the description proceeds, are achieved by the invention.

An orthotic insole in accordance with the invention comprises a support having a foot-like outline. The support includes an elastically deformable first portion designed to underlie the big toe, an elastically deformable second portion designed to underlie the first metatarsal in the region of the head thereof, an elastically deformable third portion designed to underlie the fifth metatarsal in the region of the head thereof, an elastically-deformable fourth portion designed to underlie the calcaneous, and a fifth portion designed to underlie the metatarsal arch. Each of these portions has an approximately uniform hardness with the hardness of the fifth portion being greater than that of the four other portions.

In the insole of the invention, the hardnesses of the different portions are selected in dependence upon the natural forces acting on the sole of the foot both when standing and walking. This allows the compensatory pressure provided by the insole in the region of the arch to be different than for parts of the foot which have little soft tissue and are subjected to large forces. Thus, the insole can perform a load relieving function. The insole can act not only to ease the discomfort caused by pressure but also to reduce compressive and impact loads.

The insole is preferably flexible in its entirety. The arch structure of the foot is then not rigidly supported thereby allowing the residual functions of ligaments and muscles to be effectively preserved.

The novel features which are considered as characteristic of the invention are set forth in particular in the appended claims. The improved orthotic insole itself, however, both as to its construction and its mode of operation, together with additional features and advantages thereof, will be best understood from a perusal of the following detailed description of certain specific embodiments when read in conjunction with the accompanying drawings.

BRIEF DESCRIPTION OF THE DRAWINGS

FIG. 5 is a bottom view of an additional embodiment of an orthotic insole in accordance with the invention; and FIG. 6 is a perspective view of the insole of FIG. 5.

DESCRIPTION OF THE PREFERRED EMBODIMENTS

Figure 1:
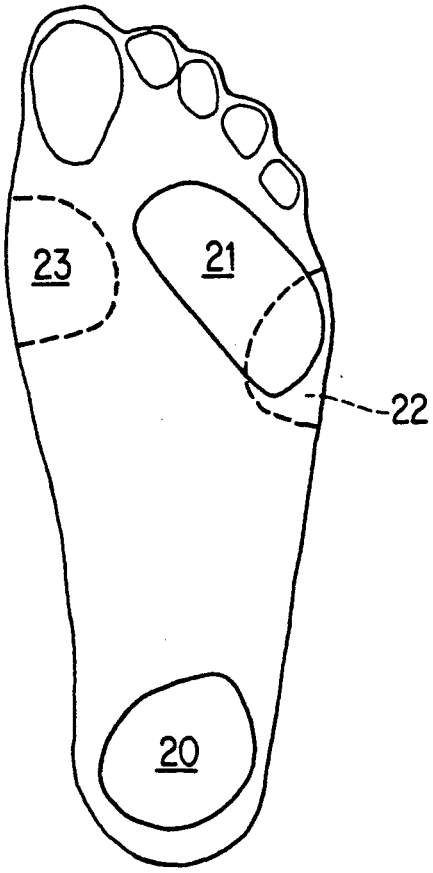
FIG. 1 is a bottom view of a foot showing the load concentrations in a normal foot when a person stands with both feet on the ground.

FIG. 1 illustrates the load concentrations on the sole of a normal foot when a person stands with both feet on a flat surface. The load is concentrated mainly in an area 20 adjacent to the calcaneus and an area 21 adjacent to the metatarsal heads. The load area 21 projects from the region 22 of the fifth metatarsal head towards the region 23 of the first metatarsal head but terminates short of the region 23. Thus, a normal person standing with both feet on a flat surface may be considered to be subjected to four-point loading.

Figure 2:
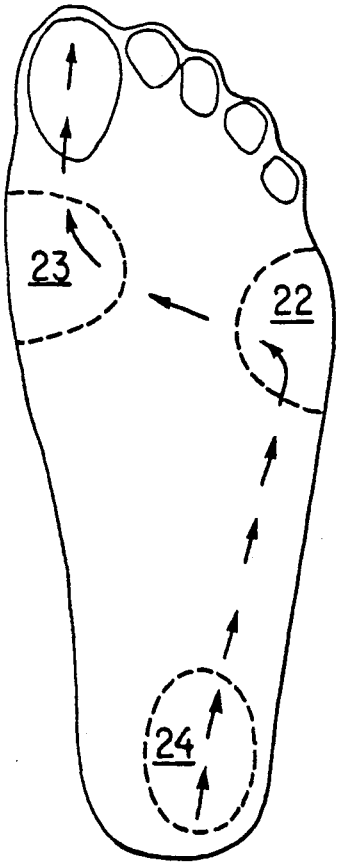
FIG. 2 is a bottom view of a foot showing the load shift pattern in a normal foot during walking.

FIG. 2 shows the load shift pattern in a normal foot when a person walks with a normal gait. Under such circumstances, the foot will initially contact the ground in the region 24 of the calcaneus and will push away from the ground in the region of the big toe. As illustrated by the arrows, the foot is accordingly first loaded in the calcaneus region 24. The load thereupon shifts along the lateral part of the foot to the fifth metatarsal head 22 where the direction of loading changes so that the load now shifts transversely of the foot towards the first metatarsal head 23. The direction of loading changes once more at the first metatarsal head 23 and the load again shifts longitudinally of the foot to the big toe. The major forces exerted on the foot during walking occur at the calcaneus region 24 which is subjected to an impact when the foot contacts the ground; the big toe which pushes the foot away from the ground; and the fifth and first metatarsal heads 22,23 where the direction of loading changes.

In accordance with the invention, the design of an orthotic insole is based on the normal or standard loading patterns illustrated in FIGS. 1 and 2, that is, on both static and dynamic considerations. As shown by FIGS. 1 and 2, the most highly loaded regions of the foot from the viewpoint of static and dynamic loading combined are the calcaneus region 24, the fifth metatarsal head 22, the first metatarsal head 23 and the big toe. The insole of the invention is designed to support these regions differently than the less highly loaded and arched regions of the foot and, to this end, different portions of the insole have different hardnesses.

Figure 3:
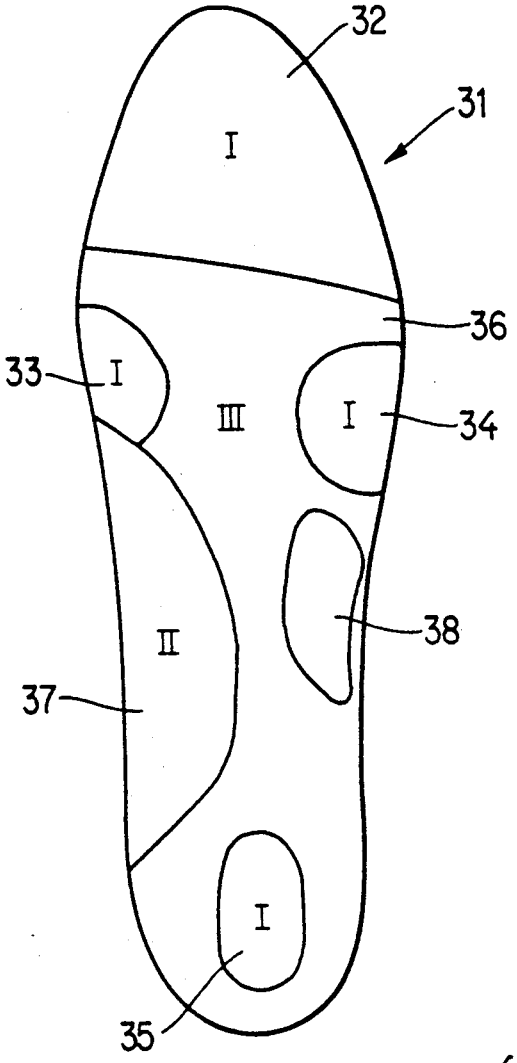
FIG. 3 is a bottom view of one embodiment of an orthotic insole in accordance with the invention.

One embodiment of the insole is shown in FIG. 3. The insole includes or is constituted by a support or body 31 which can be removably inserted in an article of footwear and has an outline resembling that of a foot. The support 31 has a portion or module 32 which is arranged to underlie the toes, a portion or module 33 which is arranged to underlie the first metatarsal head, a portion or module 34 which is arranged to underlie the fifth metatarsal head and a portion or module 35 which is arranged to underlie the calcaneus. The support 31 further has a portion or module 36 which is arranged to underlie the metatarsal arch as well as regions of the foot posterior to the metatarsal arch. The portion 36 extends back to the region of the heel and surrounds the calcaneus portion 35. The underside of the portion 36, i.e., the side which is to face the sole of the article of footwear, may be formed with a recess in the area which underlies the medial longitudinal arch and such recess may accommodate a wedge-like arch-supporting member or module 37. The arch-supporting member 37 is preferably interchangeable and, to this end, may be releasably secured in the recess, e.g., by means of a suitable adhesive. The underside of the portion 36 of the support 31 may also be provided with a cavity 38 which underlies and functions as a load-relieving area for the lateral longitudinal arch.

The toe portion 32, metatarsal head portions 33,34 and calcaneus portion 35 of the support 31 all constitute resilient cushions. Thus, each of the portions 32,33,34,35 comprises an elastically deformable or yieldable material of relatively low hardness. All of the portions 32,33,34,35 have about the same hardness and the hardness remains approximately constant throughout each of the portions 32,33,34,35.

The portion 36 of the support 31, which underlies the metatarsal arch as well as regions of the foot which are less highly loaded than the big toe, the first and fifth metatarsal heads and the calcaneus, has a greater hardness than the toe portion 32, metatarsal head portions 33,34 and calcaneus portion 35. The portion 36 accordingly constitutes a relatively firm base for the foot. Although the portion 36 is relatively firm, the portion 36 need not be rigid and is preferably flexible or elastically deformable. The hardness of the portion 36 is at least approximately constant throughout the portion 36.

The arch-supporting member 37 again has a hardness greater than that of the toe portion 32, the metatarsal head portions 33,34 and the calcaneus portion 35. However, depending upon the ailment being treated, and hence upon the degree of support required for the longitudinal medial arch, the arch-supporting member 37 may have a hardness less than, greater than or equal to that of the portion 36. As mentioned earlier, the arch-supporting member 37 is preferably interchangeable and this allows an arch-supporting member of given hardness to be replaced by an arch-supporting member of different hardness should this become appropriate as treatment progresses. It also allows the height of the arch-supporting member to be changed, if indicated. The arch-supporting member 37 has an approximately uniform hardness and, as before, it is preferred for the arch-supporting member 37 to be flexible or elastically deformable. The arch-supporting member 37 here has a hardness less than that of the portion 36 underlying the metatarsal arch and posterior regions of the foot. The relatively low hardness of the arch-supporting member 37 combined with its flexibility makes it possible for the longitudinal medial arch to flatten and curve in a fairly normal manner. This may be desirable in that it can help to preserve residual functions of muscles and ligaments. Flexing of the longitudinal medial arch can be enhanced by hollowing out the arch-supporting member 37.

The support 31 will normally be manufactured without the arch-supporting member 37. The support 31 may be accompanied by a selection of arch-supporting members having different hardnesses and/or heights so that an arch-supporting member appropriate for a particular ailment can be mounted in the recess provided therefor in the support 31.

In FIG. 3, the relative hardnesses of the arch-supporting member 37 and the various portions 32,33,34,35,36 are indicated by roman numerals. The roman numeral I represents the lowest hardness, the roman numeral III the greatest hardness and the roman numeral II an intermediate hardness.

Figure 4:
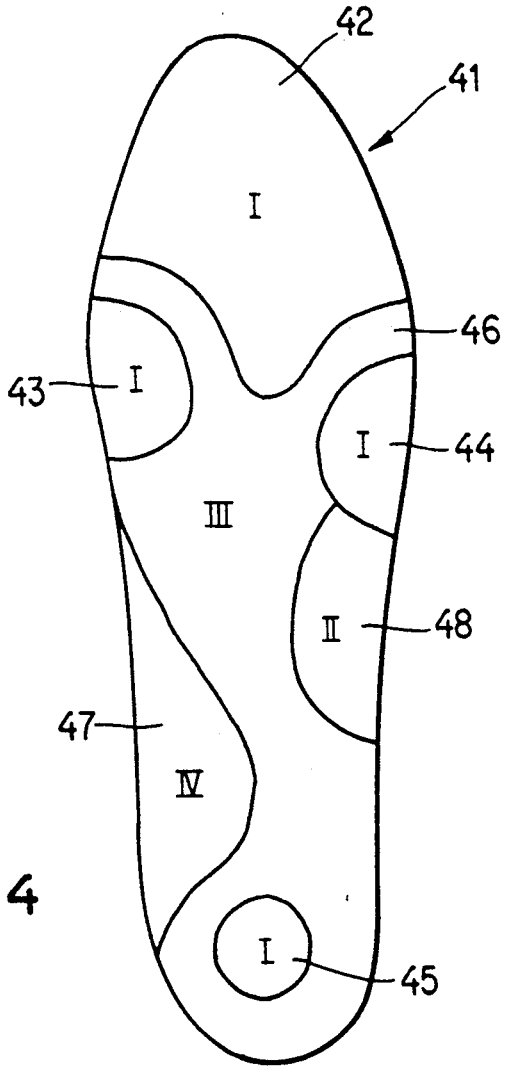
FIG. 4 is a bottom view of another embodiment of an orthotic insole according to the invention.

A second embodiment of the insole according to the invention is shown in FIG. 4. The insole of FIG. 4 again includes or is constituted by a support or body 41 which can be removably inserted in an article of footwear and has an outline resembling that of a foot. The support 41 has a portion or module 42 which is arranged to underlie the toes, a portion or module 43 which is arranged to underlie the first metatarsal head, a portion or module 44 which is arranged to underlie the fifth metatarsal head and a portion or module 45 which is arranged to underlie the calcaneus. The portions 42,43,44,45, which constitute resilient cushions, may be identical to the portions 32,33,34,35 of FIG. 3 as regards elastic deformation and hardness. The support 41 further has a portion or module 46 which is arranged to underlie the metatarsal arch as well as regions of the foot posterior to the metatarsal arch. Similarly to the portion 36 of FIG. 3, the portion 46 extends back to the region of the heel and surrounds the calcaneus portion 45. The portion 46, which has a hardness greater than that of the toe portion 42, metatarsal head portions 43,44 and calcaneus portion 45, may correspond to the portion 36 of FIG. 3 with respect to hardness and flexibility. The underside of the portion 46 may be formed with a recess in the area which underlies the medial longitudinal arch and such recess may, as in FIG. 3, accommodate an interchangeable, wedge-like, arch-supporting member or module 47. However, in contrast to the arch-supporting member 37 of FIG. 3 which has a lower hardness than the portion 36 underlying the metatarsal arch and posterior regions of the foot, the arch-supporting member 47 has a greater hardness than the portion 46. The relatively great hardness of the arch-supporting member 47 may be advantageous in the treatment of ailments requiring relatively firm support for the longitudinal medial arch. In spite of its relatively great hardness, it is preferred for the arch-supporting member 47 to have a certain degree of flexibility, or to be capable of undergoing a certain amount of elastic deformation, so that the longitudinal medial arch has some freedom to flex. The flexibility of the arch-supporting member 47 may be increased, if necessary, by removing material from the arch-supporting member 47 in order to form a concavity therein.

The insole of FIG. 4 additionally differs from that of FIG. 3 in that the cavity 38 of FIG. 3 is eliminated. Instead, the support 41 of FIG. 4 has a portion or module 48 which underlies the lateral longitudinal arch and has a hardness greater than that of the toe portion 42, metatarsal head portions 43,44 and calcaneus portion 45 but less than that of the portion 46 which underlies the metatarsal arch and posterior regions of the foot. The lateral arch portion 48 is preferably flexible or elastically deformable and may serve as a load-relieving area for the lateral longitudinal arch.

The arch-supporting member 47, as well as each of the portions 42,43,44,45,46,48 of the support 41, has an approximately uniform hardness.

Like the support 31 of FIG. 3, the support 41 will normally be manufactured without the arch-supporting member 47 and may be supplied together with a selection of arch-supporting members having different hardnesses and/or heights.

In FIG. 4, the relative hardnesses of the arch-supporting member 47 and the various portions 42,43,44,45,46,48 are once more indicated by roman numerals. Here, the roman numeral I represents the lowest hardness, the roman numeral IV the greatest hardness, the roman numeral II an intermediate hardness greater than that represented by the roman numeral I but less than that represented by the roman numeral IV, and the roman numeral III an intermediate hardness greater than that represented by the roman numeral II but less than that represented by the roman numeral IV.

The roman numerals I,II,III,IV in FIGS. 5 and 6, which illustrate a third embodiment of the insole in accordance with the invention, have the same meanings as the corresponding roman numerals in FIG. 4. The insole of FIGS. 5 and 6 again includes or is constituted by a support or body 1 which can be removably inserted in an article of footwear and has an outline resembling that of a foot. The support 1 corresponds to the support 41 of FIG. 4 in that the support 1 has a portion or module 2 which is arranged to underlie the toes, a portion or module 9 which is arranged to underlie the first metatarsal head, a portion or module 4 which is arranged to underlie the fifth metatarsal head, a portion or module 11 which is arranged to underlie the calcaneus, a portion or module 5 which is arranged to underlie the lateral longitudinal arch and a portion or module 6 which is arranged to underlie the metatarsal arch as well as posterior regions of the foot. The portions 2,9,4,11,5,6 may be identical to the corresponding portions 42,43,44,45, 48,46 of the support 41 of FIG. 4 as regards hardness and flexibility. The support 1 further resembles the support 41 to the extent that the underside of the support 1 is provided with a recess in the area which underlies the medial longitudinal arch. The recess accommodates an interchangeable, wedge-like, arch-supporting member or module 7 which may be identical to the arch-supporting member 47 of FIG. 4 with respect to hardness and flexibility.

The support 1 of FIGS. 5 and 6 differs from the support 41 of FIG. 4 in that the portion 6 of the support 1, which underlies the metatarsal arch and posterior regions of the foot, terminates short of the calcaneus portion 11. Thus, while the portion 46 of the support 41 extends back to the region of the heel and surrounds the calcaneus portion 45, the portion 6 of the support 1 does not surround the calcaneus portion 11. Instead, the calcaneus portion 11 is surrounded by a portion or module 10 of the support 1 having a hardness greater than that of the calcaneus portion 11 but less than that of the portion 6. The portion 10, which is arranged to underlie the heel, may serve as a load-relieving area for the latter. The portion 10 is preferably flexible or elastically deformable and the hardness of the portion 10 is approximately constant throughout the same.

The support 1, 31 or 41 can be supplied with a selection of metatarsal pads or modules which are designed to be secured to the upper side of the support 1, 31 or 41, i.e., the side of the support 1, 31 or 41 facing the foot, in the region of the metatarsals. A metatarsal pad is shown in FIG. 5 at 13.

FIGS. 5 and 6 illustrate one manner of securing a metatarsal pad to the support 1, 31 or 41. As shown, the metatarsal area of the support 1 is provided with an elongated longitudinal slot which extends through the thickness of the support 1, that is, from the upper side to the underside of the support 1. A strip 15 of hook and 100 p type fasteners such as VELCRO® or the like is mounted on the underside of the support 1 to either side of the slot 12 and extends along substantially the entire length of the latter. A pair of straps or bands 14 of VELCRO® or the like is mounted on the underside of the metatarsal pad 13, i.e., on the side of the pad 13 which faces the support 1. The bands 4 are designed to project through the slot 12 from top to bottom. The length of the bands 14 is such that a segment of each band 14 protrudes beyond the underside of the support 1 when the pad 13 is properly positioned on the upper side of the support 1. Each segment can be bent laterally to mate with a respective strip 15 and thereby releasably secure the pad 13 to the support 1. The width of each band 14 is smaller than the length of the slot 12. This allows the pad 13 to be shifted longitudinally in order to optimally position the pad 13.

The metatarsal pad 13 can be secured to the support 1 by means other than the cooperating VELCRO® bands and strips 14,15. For example, pad 13 can be secured to the support 1 via an adhesive.

The metatarsal pads furnished with the support 1, 31 or 41 may have different hardnesses and/or widths and/or heights. This makes it possible to select a matatarsal pad based upon the ailment to be treated and upon the size of the user's foot. The metatarsal pads can have hardnesses of I,II,III or IV as well as intermediate hardnesses. For instance, the metatarsal pad 13 is shown as having a hardness between III and IV.

The support 1, 31 or 41 can further be supplied together with supination and pronation members or modules in order to compensate for pronation and supination tendencies. The supination and pronation members, which may be wedge-shaped, have not been illustrated so as to preserve clarity. These may again have different hardnesses and/or widths and/or heights.

The thickness of the insole according to the invention may vary progressively from one end to the other as illustrated in FIG. 6. By way of example, the anterior end may have a thickness of about 2 mm while the posterior end has a thickness of at least 4 mm. The maximum thickness of the posterior end is approximately 10 mm.

As mentioned previously, the insole of the invention is designed to be removably inserted in an article of footwear. To this end, the insole is preferably free of means for securing the same to an article of footwear.

The insole of the invention has a number of different hardnesses which are distributed among several areas of the insole in a predetermined manner. While it is preferred to have at least four different hardnesses and to distribute these hardnesses among at least six areas of the insole as illustrated in FIG. 4 (four hardnesses distributed among seven areas) and FIGS. 5–6 (four hardnesses distributed among eight areas), other hardness distributions are possible as, for instance, in FIG. 3 (three hardnesses distributed among six areas). An advantageous hardness distribution contemplated by the invention consists of four discrete hardnesses which are distributed among ten discrete areas.

The insole in accordance with the invention may comprise a high-quality, wear-resistant, foamed material. Such a material has long-term elasticity and dynamics thereby allowing long life to be achieved. By way of example, a suitable material for use in the insole of the invention is polyurethane. This is a foamed material which can assume up to eleven different hardness values.

The portions 2, 4–6 and 9–11 of the support 1; the portions 32–36 of the support 31; and the portions 42–46 and 48 of the support 41 may be integral with one another, that is, may be formed at one time from the same mass of material. Such mass is preferably injection molded to produce the portions 2, 4–6 and 9–11 of the support 1; the portions 32–36 of the support 31; or the portions 42–46 and 48 of the support 41. Alternatively, one or more of the portions 2, 4–6 and 9–11 of the support 1; or of the portions 32–36 of the support 31; or of the portions 42–46 and 48 of the support 41 are produced separately as discrete modules, preferably by injection molding. The portions 2, 4–6 and 9–11 of the support 1; the portions 32–36 of the support 31; or the portions 42–46 and 48 of the support 41 are thereafter joined to one another in any suitable manner such as, for instance, by welding or fusion.

The insole according to the invention provides separate support for regions of the foot subjected to different pressures and loads. Such separate support is achieved by combining modules of different hardness to create a dynamic loading area and enable individualized arch correction to be obtained. In this manner, it becomes possible to protect irritated zones on the sole of the foot such as heel spurs and calluses.

The insole of the invention can be used as a dynamic corrective and load-relieving insole for all changes in foot form and arch structure in adults as well as children. The insole can further be used in cases of forefoot changes with toe deformations and calcaneal changes with incorrect foot position.

Based on diagnostic and therapeutic considerations, it is necessary to accurately differentiate between morphological, static and dynamic disturbances of individual regions of the foot. Foot ailments having a purely functional basis do not require rigid support but should be subjected to a reparative and stimulating action. When treating the foot, it should be able to adapt to the variable structure of the ground via its physiological load-relieving zones. Furthermore, the foot should be able to react to shear forces in different planes using the degrees of freedom of its various joints.

As noted previously, the insole of the invention may be flexible in its entirety. This overall flexibility combined with the differing flexibilities of different portions of the insole enables the above requirements to be satisfied. When the structure of the foot has developed improperly or has undergone deformation, the insole makes it possible to achieve support and load relief in a manner such that bones and connective tissue, as well as musculature and skin, are protected. Moreover, the dynamic functions of the foot, involving bending and stretching in various planes, are not inhibited as is the case with rigid insoles. Movement, walking, turning and even jumping can be enhanced by the insole according to the invention.

The variable nature of the support offered by the insole of the invention upon contact with the ground also makes it possible to enhance the sensitivity of the sole of the foot, which is important for human stature and mobility. The insole can thus correct deformation while simultaneously, by stimulating the musculature of the foot, achieving a lasting improvement in function as regards stability and mobility. As a result, the insole can even be used to provide correction and support for a developing child's foot when indicated by defects in form or function.

The insole according to the invention can additionally be used in modern movement therapy to treat motor disturbances.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An insole, comprising a support having a foot-like outline, said support having an elastically deformable first portion designed to underlie the big toe, an elastically deformable second portion designed to underlie the first metatarsal in the region of the head thereof, an elastically deformable third portion designed to underlie the fifth metatarsal in the region of the head thereof, an elastically deformable fourth portion designed to underlie the calcaneous and a fifth portion designed to underlie the metatarsal arch, each said portions having an approximately uniform hardness, and the hardness of said fifth portion exceeding that of each of the others of said portions, said support further having a sixth portion designed to underlie the medial longitudinal arch and means for enabling said sixth portion to be interchanged for changing the hardness of said sixth portion.

2. The insole of claim 1, wherein said first portion is designed to underlie all of the toes.

3. The insole of claim 1, wherein said first, second, third and fourth portions have approximately the same hardness.

4. The insole of claim 1, said sixth portion having an approximately uniform hardness greater than that of each of said first, second, third and fourth portions.

5. The insole of claim 4, wherein said sixth portion has a hardness less than that of said fifth portion.

6. The insole of claim 4, wherein said support has a seventh portion designed to underlie the lateral longitudinal arch, said seventh portion having an approximately uniform hardness greater than that of each of said first, second, third and fourth portions.

7. The insole of claim 6, wherein said sixth portion has a hardness greater than that of said fifth portion and greater than that of said seventh portion.

8. The insole of claim 6, wherein said seventh portion has a hardness less than that of said fifth portion and less than that of said sixth portion.

9. The insole of claim 8, wherein said fifth portion has a hardness less than that of said sixth portion.

10. The insole of claim 8, wherein said support has an eighth portion surrounding said fourth portion, said eighth portion having an approximately uniform hardness greater than that of each of said first, second, third and fourth portions.

11. The insole of claim 10, wherein said eighth portion has a hardness less than that of said fifth portion and less than that of said sixth portion.

12. The insole of claim 11, wherein said fifth portion has a hardness less than that of said sixth portion.

13. The insole of claim 12, wherein said seventh and eighth portions have approximately the same hardness.

14. The insole of claim 4, wherein said support has a seventh portion designed to underlie the lateral longitudinal arch, said support having a side which is designed to face away from the foot, and said seventh portion being provided with a cavity at said side.

15. The insole of claim 1, wherein said fifth portion surrounds said fourth portion.

16. The insole of claim 1, wherein at least one of said portions is fused to another of said portions.

17. The insole of claim 1, wherein said support consists at least in part of injection molded foamed material.

18. The insole of claim 1, wherein said support comprises polyurethane.

19. The insole of claim 1, further comprising a metatarsal pad, and means for releasably securing said metatarsal pad to said support.

20. The insole of claim 19, wherein said securing means comprises a VELCRO ® strip on said metatarsal pad and a cooperating VELCRO ® strip on said support.

21. The insole of claim 19, wherein said support is provided with a slit and said securing means comprises a strap for said metatarsal pad designed to extend through said slit.

22. The insole of claim 21, wherein said slit extends in longitudinal direction of said support and has a predetermined length, said strap having a predetermined width smaller than said predetermined length so as to permit adjustment of said strap and said metatarsal pad longitudinally of said support.

23. The insole of claim 1, wherein said support is removably receivable in an article of footwear.

24. The insole of claim 23, wherein said support is devoid of means for securing said support to an article of footwear.

25. The insole of claim 1, wherein said support is flexible in its entirety.

* * * * *